US010118762B2

(12) United States Patent
Stark et al.

(10) Patent No.: US 10,118,762 B2
(45) Date of Patent: Nov. 6, 2018

(54) WASTE RECEPTACLE WITH PEDAL-OPERATED LID

(71) Applicant: Rubbermaid Commercial Products LLC, Atlanta, GA (US)

(72) Inventors: Jeffrey Stark, Davidson, NC (US); Evan Barna, Davidson, NC (US); William M. Charrier, Winchester, VA (US)

(73) Assignee: Rubbermaid Commercial Products LLC, Atlanta, GA (US)

( * ) Notice: Subject to any disclaimer, the term of this patent is extended or adjusted under 35 U.S.C. 154(b) by 0 days.

(21) Appl. No.: 15/749,956

(22) PCT Filed: Aug. 3, 2016

(86) PCT No.: PCT/US2016/045237
§ 371 (c)(1),
(2) Date: Feb. 2, 2018

(87) PCT Pub. No.: WO2017/023965
PCT Pub. Date: Feb. 9, 2017

(65) Prior Publication Data

US 2018/0222673 A1 Aug. 9, 2018

Related U.S. Application Data

(60) Provisional application No. 62/200,360, filed on Aug. 3, 2015.

(51) Int. Cl.
*B65F 1/02* (2006.01)
*B65F 1/16* (2006.01)
*B65F 1/14* (2006.01)

(52) U.S. Cl.
CPC ..... *B65F 1/163* (2013.01); *B65F 1/02* (2013.01); *B65F 1/1473* (2013.01);
(Continued)

(58) Field of Classification Search
CPC ..... B65F 2220/12
See application file for complete search history.

(56) References Cited

U.S. PATENT DOCUMENTS 2,216,279 A 10/1940 Packer
3,008,604 A * 11/1961 Garner ..... B65F 1/08 206/205

(Continued)

FOREIGN PATENT DOCUMENTS

DE 485593 C 11/1929
EP 2594508 A2 5/2013

(Continued)

OTHER PUBLICATIONS

International Search Report and Written Opinion for International Application No. PCT/US2016/045237 dated Sep. 22, 2016 (11 pages).

*Primary Examiner* — Erez Gurari
(74) *Attorney, Agent, or Firm* — Eversheds Sutherland (US) LLP

(57) ABSTRACT

Waste receptacles (100) with pedal-operated lids (108) are provided. A waste receptacle includes an enclosure (102) having an enclosed base portion (104) and at least one sidewall (106) defining an open top portion (105), a lid (108) hingedly coupled to the enclosure and defining a channel, a pedal (112) pivotably coupled to the base portion, and an elongated lift rod (116) having a first end coupled to the pedal and a second end being disposed in the first end of the channel when the pedal is in the first position and the lid is disposed in a closed position and being disposed in the second end of the channel when the pedal is in the second position.

21 Claims, 12 Drawing Sheets

(52) U.S. Cl.
CPC ... *B65F 2210/132* (2013.01); *B65F 2210/181* (2013.01); *B65F 2220/12* (2013.01)

(56) References Cited

U.S. PATENT DOCUMENTS

| | | | | |
|---|---|---|---|---|
| 5,071,024 | A | 12/1991 | Delmerico | |
| 5,147,055 | A * | 9/1992 | Samson | B65F 1/1615 220/252 |
| 7,712,623 | B2 | 5/2010 | Wentz | |
| 8,235,237 | B1 * | 8/2012 | Stravitz | B65F 1/1623 220/263 |
| 9,809,239 | B1 * | 11/2017 | Reiss | B62B 3/004 |
| 2002/0092853 | A1 * | 7/2002 | Wang | B65F 1/1623 220/263 |
| 2003/0230576 | A1 * | 12/2003 | Lin | B65F 1/163 220/263 |
| 2005/0006536 | A1 * | 1/2005 | Yang | B65F 1/068 248/99 |
| 2005/0044819 | A1 * | 3/2005 | Chomik | B65B 7/12 53/459 |
| 2006/0249510 | A1 * | 11/2006 | Lin | B65F 1/163 220/263 |
| 2008/0245794 | A1 * | 10/2008 | Escobar | B65F 1/163 220/263 |
| 2010/0084235 | A1 * | 4/2010 | Lu | B65F 1/163 188/280 |
| 2010/0294769 | A1 * | 11/2010 | Lee | B65F 1/163 220/263 |
| 2012/0305561 | A1 * | 12/2012 | Haimoff | B65F 1/163 220/263 |
| 2014/0183193 | A1 * | 7/2014 | Hammond | B65F 1/002 220/87.2 |
| 2017/0197786 | A1 * | 7/2017 | Shek | B65F 1/163 |

FOREIGN PATENT DOCUMENTS

| | | |
|---|---|---|
| WO | 00/53515 | 9/2000 |
| WO | 2007/092485 A1 | 8/2007 |

* cited by examiner

WASTE RECEPTACLE WITH PEDAL-OPERATED LID

CROSS-REFERENCE TO RELATED APPLICATIONS

The instant application is a U.S. national stage application claiming priority to International Application No. PCT/US2016/045237, filed Aug. 3, 2016, which application claims priority to U.S. Provisional Application No. 62/200,360, filed Aug. 3, 2015, the disclosures of which are incorporated by reference herein in their entirety.

TECHNICAL FIELD

The present application generally relates to waste receptacles, and, more specifically, relates to waste receptacles having a pedal-operated lift rod for opening the lid of the receptacle.

BACKGROUND

Waste receptacles or trash cans having pedal-operated lid opening mechanisms are known for interior receptacles. However, these interior receptacles are typically of limited capacity and are designed for in-home usage. Typically, the lid opening mechanism of these receptacles is rigidly attached to the lid, such that the maximum angle that the lid may be opened is limited by the stroke of the pedal. Thus, these receptacles do not allow for opening of the lid beyond the maximum angle allowed by operation of the pedal, which is usually less than 90 degrees from the closed position of the lid.

However, there is a need for receptacles that provide pedal-operated lid opening and in which the lid can be fully opened, such as up to 270 degrees. For example, waste receptacles for street-side use and automated collection may be required by code to have a fully openable, such as a lid that opens between 180 and 270 degrees. Additionally, it would be desirable to have a pedal-operated opening mechanism for large format wheeled waste receptacles, to improve the ease of use of these receptacles.

SUMMARY

In embodiments of the disclosure, a waste receptacle is provided. The waste receptacle includes an enclosure having an enclosed base portion and at least one sidewall extending from the base portion, the at least one sidewall defining an open top portion to receive waste material therethrough; a lid hingedly coupled to the enclosure, the lid defining a channel having a first end and a second end; a pedal pivotably coupled to the base portion and pivotable from a first position to a second position; and an elongated lift rod having a first end coupled to the pedal and a second end that is distal the first end, the second end being disposed in the first end of the channel when the pedal is in the first position and the lid is disposed in a closed position abutting the open top portion of the base portion and being disposed in the second end of the channel when the pedal is in the second position, wherein the lid is disposed at a predetermined maximum pedal-adjusted angle of from about 60 degrees to about 90 degrees, measured relative the closed position, when the pedal is in the second position, and, when the pedal is in the first position, the lid is manually rotatable from the closed position to a maximum open angle of about 270 degrees, relative the closed position.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Embodiments of the present application provide a waste receptacle having a pedal-operated lift rod that can engage and control the opening of the receptacle lid from a closed position up to a maximum pedal-adjusted angle by applying a downward force upon one end of the pedal to move that end of the pedal from a first position to a second position. In addition, the lid is manually rotatable from the closed position to an angle greater than the maximum pedal-adjusted angle when the pedal is not engaged. For example, the lid may be manually rotatable to a fully open position when the pedal is not engaged, such that the waste receptacle is suitable for automated or semi-automated waste collection.

Figure 7:
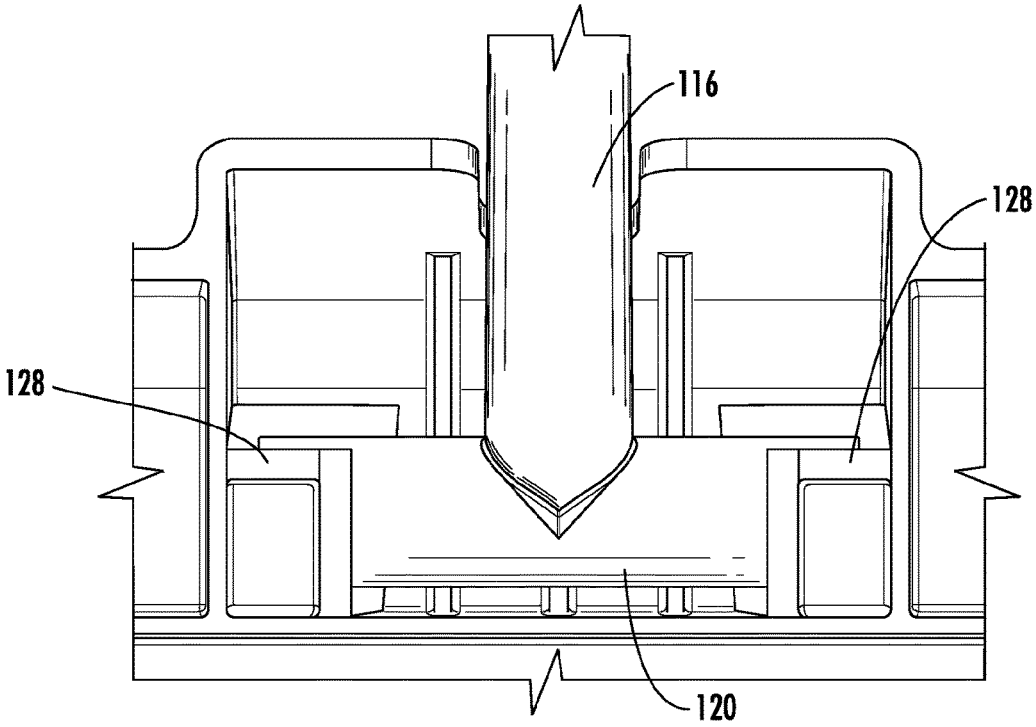
FIG. 7 is a partial bottom view of the channel of the lid of FIG. 5, with a lift rod engaged with the channel.
Figure 8:
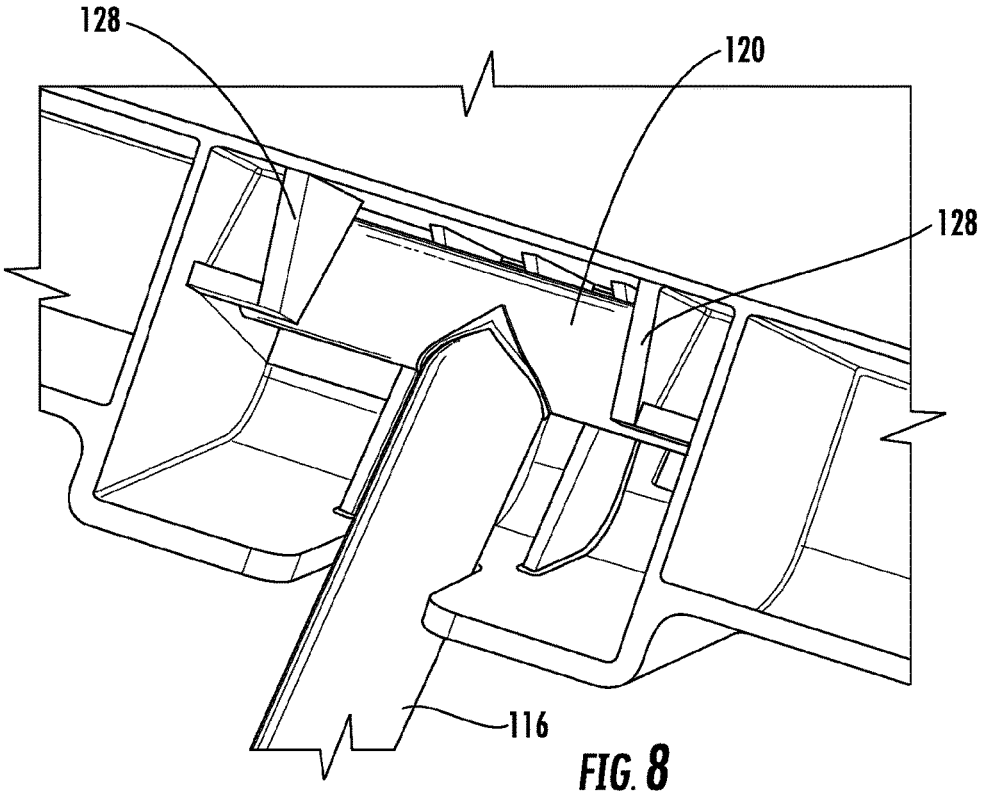
FIG. 8 is a partial lower perspective view of the channel of the lid of FIG. 6, with a lift rod engaged with the channel.

As used herein, the terms "fully open position," "fully openable," and similar terms refer to the lid of the receptacle being disposed at a maximum open angle that is approximately parallel the longitudinal axis of the receptacle. In certain example embodiments, the fully open position includes the lid being generally vertically oriented and approximately parallel to a rear wall of the receptacle, for example as illustrated at FIG. 7 of U.S. Pat. No. 5,071,024. In some embodiments, the fully open position includes the lid being rotated from between 90 and 300 degrees relative the closed lid position. In certain example embodiments, the fully open position includes the lid being rotated approximately 270 degrees relative the closed lid position. However, it should be understood that the fully open position of the lid may vary based on the particular design of the waste receptacle.

Figure 1:
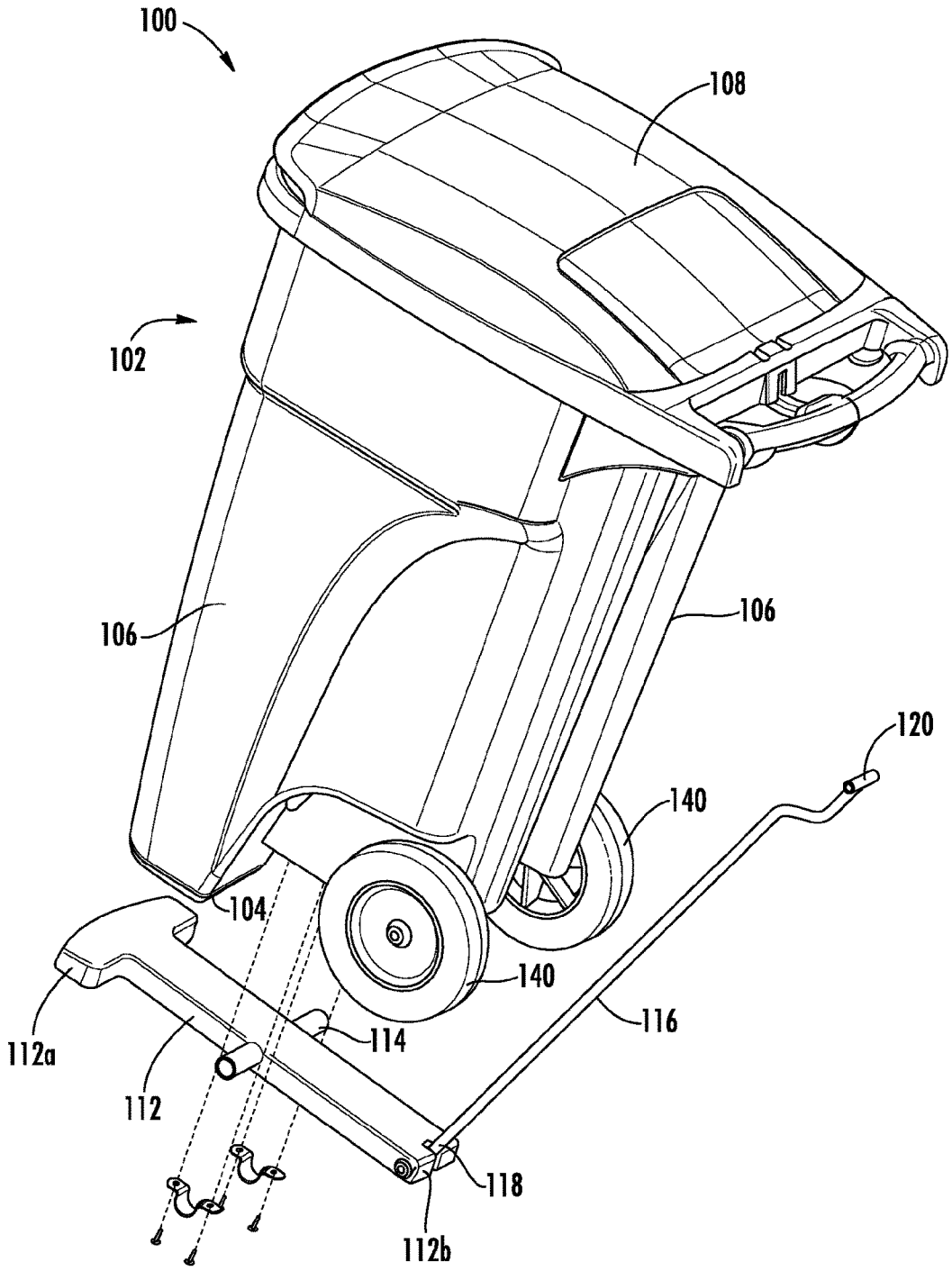
FIG. 1 is an exploded upper perspective view of an embodiment of a waste receptacle with pedal-operated lid, in accordance with the present disclosure.

Various suitable waste receptacle designs are known in the art. For example, the waste receptacle may be an interior-style receptacle, a larger format receptacle, a wheeled receptacle, or any other suitable receptacle. For example, U.S. Pat. No. 5,071,024, which is incorporated by reference herein, discloses a suitable wheeled receptacle having a hinged lid. In certain example embodiments, as shown in FIG. 1, the waste receptacle 100 includes an enclosure 102 having an enclosed base portion 104 and at least one sidewall 106 extending from the base portion 104 to define an open top portion 105 (shown in FIG. 3) to receive waste material therethrough. As used herein, the terms "enclosure" and "enclosed base portion" refer to the receptacle 100 having substantially continuous walls to contain the waste material; however, it should be appreciated that the walls may include certain openings, such as drains, vents, or other suitable openings. In certain example embodiments, as partially shown in FIG. 3, the at least one sidewall 106 includes a front wall 106*a*, a rear wall 106*b*, and two opposing sidewalls 106*c* and 106*d*. In certain example embodiments, the enclosed base portion 104 forms the bottom of the waste receptacle 100.

Figure 2:
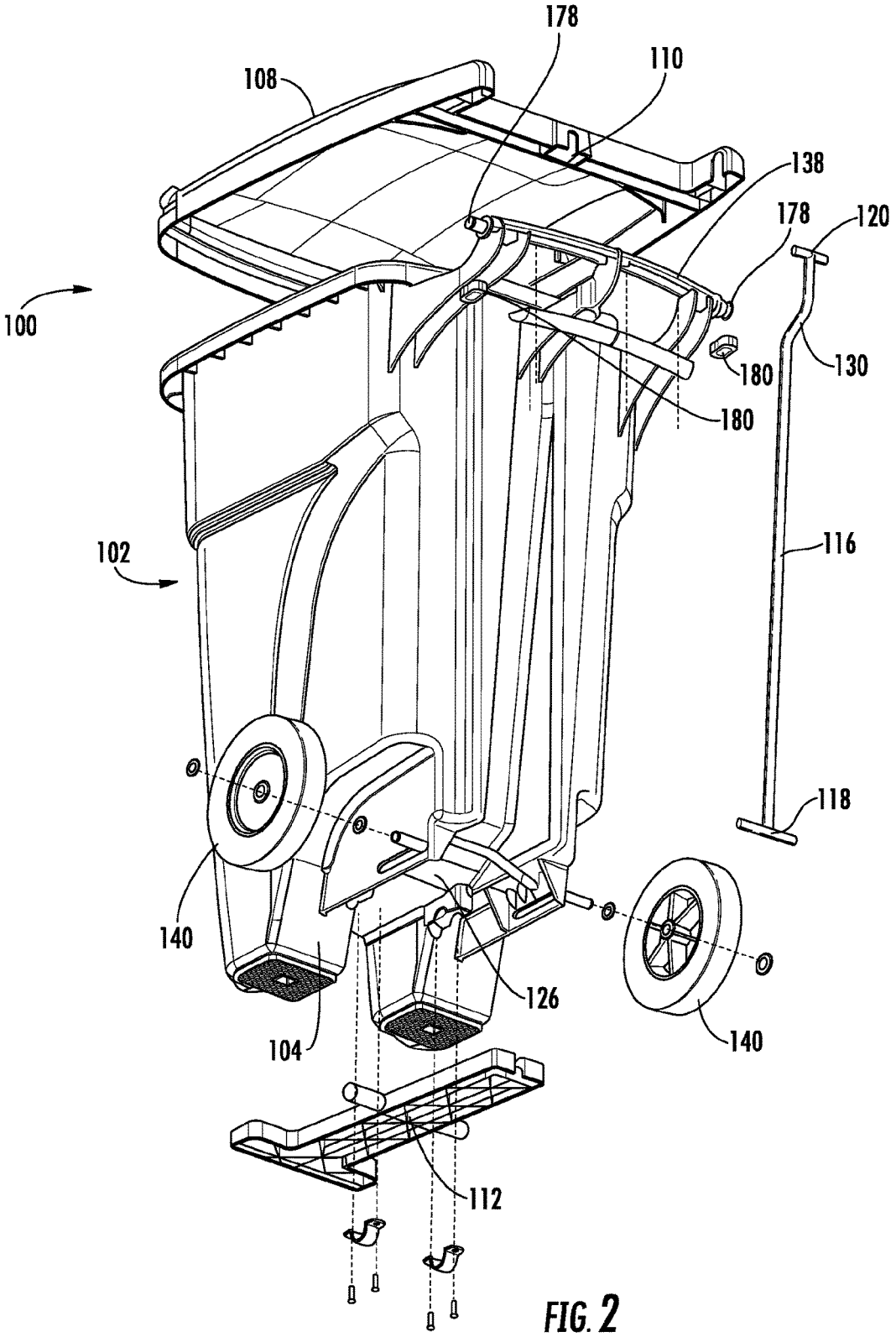
FIG. 2 is an exploded lower perspective view of an embodiment of a waste receptacle with pedal-operated lid, in accordance with the present disclosure.
Figure 17:
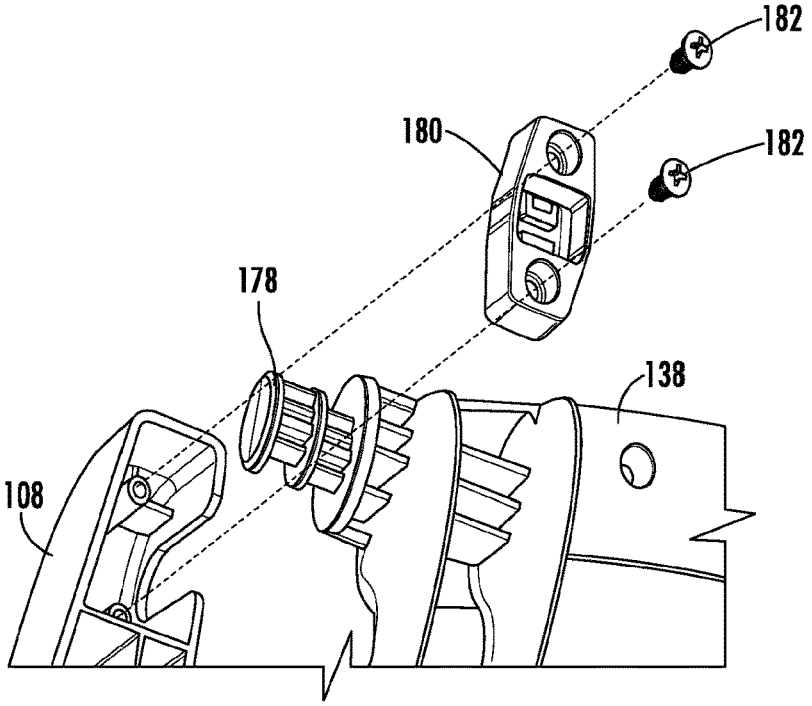
FIG. 17 is a exploded partial perspective view of the lid and enclosure of an embodiment of a waste receptacle with pedal-operated lid, in accordance with the present disclosure.
Figure 18:
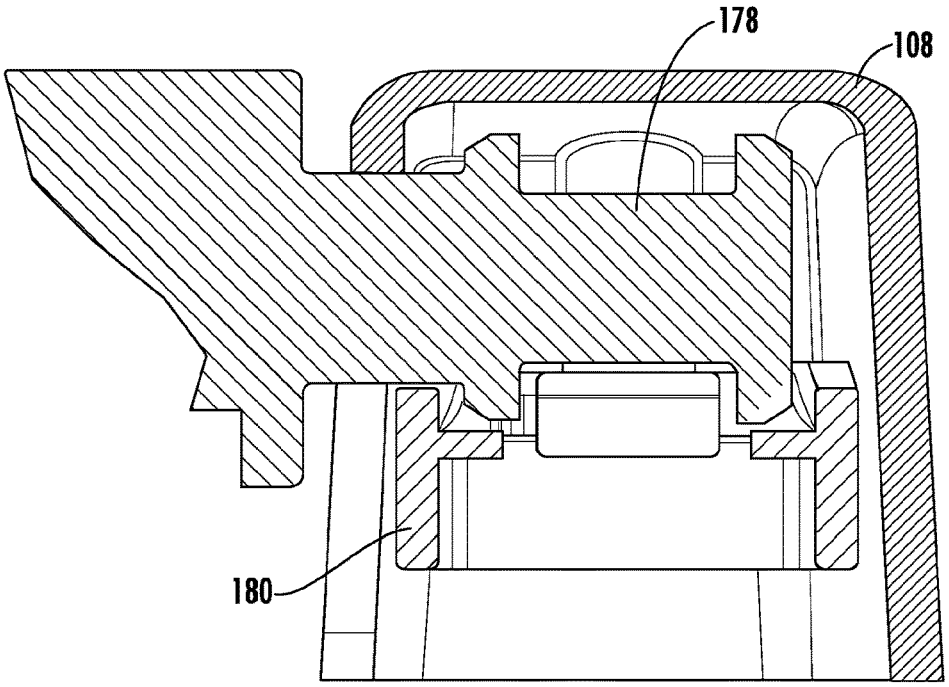
FIG. 18 is a cross-sectional partial plan view of the lid and enclosure of FIG. 17.

In certain example embodiments, as shown in FIGS. 1 and 2, the waste receptacle 100 also includes a lid 108 that is hingedly and rotatably coupled to the enclosure 102. For example, the lid 108 may be coupled to the enclosure 102 by any suitable means known in the art, such as that described in U.S. Pat. No. 5,071,024. For example, as shown in FIGS. 2, 17, and 18, the lid 108 may be coupled to the enclosure 102 by affixing retainers 180 to the lid using screws 182 or rivets. The retainers 180 interface with the pivots 178 on the handle 138 of the enclosure 103, so that the lid 108 can pivot freely but cannot come off. As used herein, the term "coupled" is used broadly and refers to components being directly or indirectly in contact with one another via any suitable fastening, connection, or attachment mechanism. In one embodiment, the lid 108 is coupled to the enclosure 102 at a position adjacent or near the open top portion 105.

Figure 13:
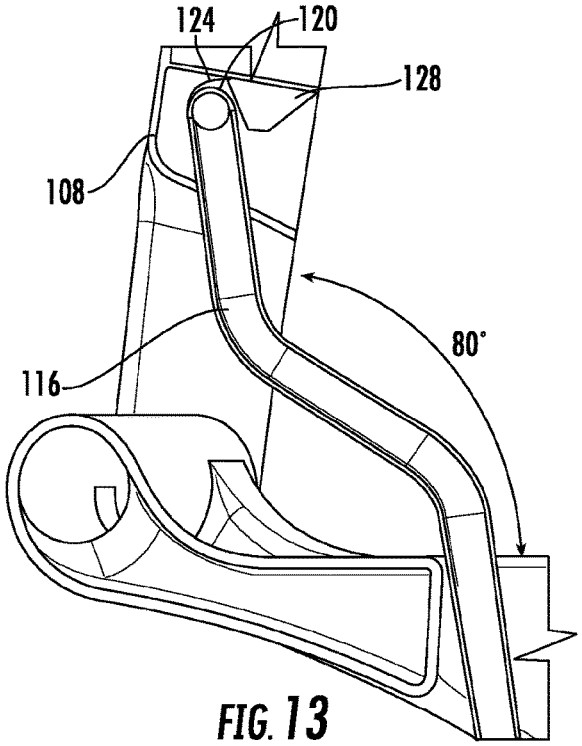
FIG. 13 is a cross-sectional partial perspective view of the lid and lift rod of the waste receptacle of FIG. 11, when the pedal is in the second position (i.e., maximum actuation).

In certain example embodiments, as shown in FIG. 1, the waste receptacle 100 also includes a pedal 112 having a first end 112*a* and a distal second end 112*b*. The pedal 112 is pivotably coupled to the base portion 104 and is pivotable from a first position to a second position. For example, the first position may be an unactuated or "at rest" position of the pedal 112, while the second position may be an actuated position achieved by a user applying a downward force on the first end 112*a* of the pedal 112 with his foot. In some example embodiments, as shown in FIGS. 2 and 13, the enclosed base portion 104 defines a channel 126 to accommodate at least a portion of the pedal 112. In some example embodiments, the pedal 112 is coupled to a pedal axle 114 that is coupled to a bottom surface of the enclosed base portion 104, such as by brackets 115 or other suitable fasteners. In some example embodiments, the pedal axle 114 is integral with and/or integrally formed with the pedal 112. The pedal 112 may be coupled to the base portion 104 such that the pedal 112 is feely pivotable about a fulcrum defined by the pedal axle 114. In certain example embodiments, the pedal 112 is pivotable from the first position to the second position upon application of at least 18 pounds of downward force upon the first end 112*a* of the pedal 112 by a user.

In certain example embodiments, as shown in FIG. 1, the waste receptacle 100 further includes an elongated lift rod 116 having a first end 118 coupled to the second end 112*b* of the pedal 112. The lift rod 116 also has a second end 120, distal from the first end 118. The lift rod 116 is coupled to the second end 112*b* of the pedal 112 at the first end 118 and engages the lid 108 at the second end 120. In one example, when a user applies a downward force on the first end 112*a* and pivots the pedal 112 from the first to the second position, the second end 112*b* of the pedal moves in a generally upward direction causing the lift rod 116 to correspondingly move in an upward direction to engage or otherwise enter a lid adjustment channel 110 and open the lid 108 up to the maximum pedal-adjusted angle. For example, the lift rod 116 may move in a direction parallel to the longitudinal axis of the waste receptacle (e.g., vertically upward) to move further into the lid adjustment channel 110 and open the lid 108.

Figure 10:
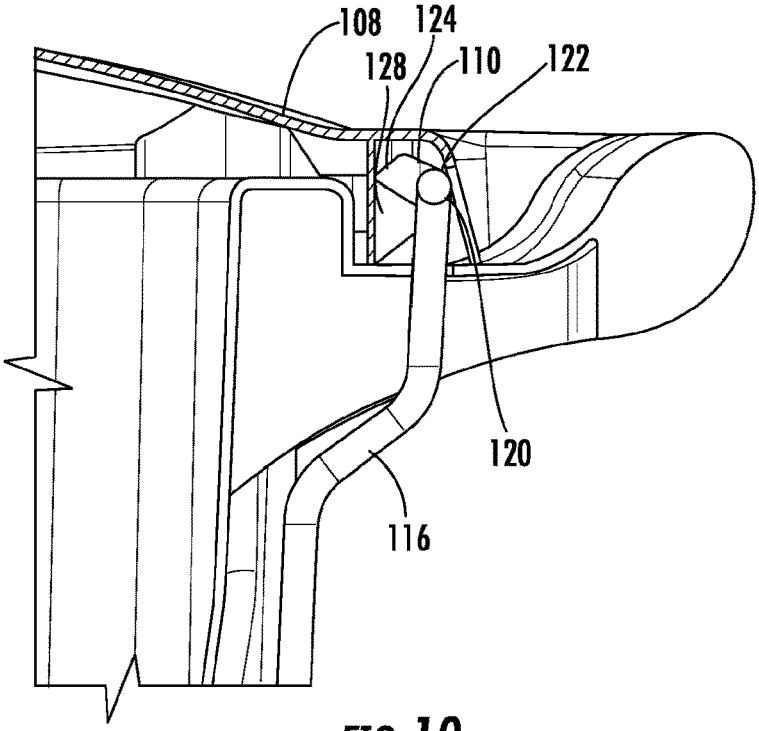
FIG. 10 is a cross-sectional partial plan view of the lid and lift rod of the waste receptacle of FIG. 9, when the pedal is moving from the first position into the second position (i.e., maximum actuation).
Figure 11:
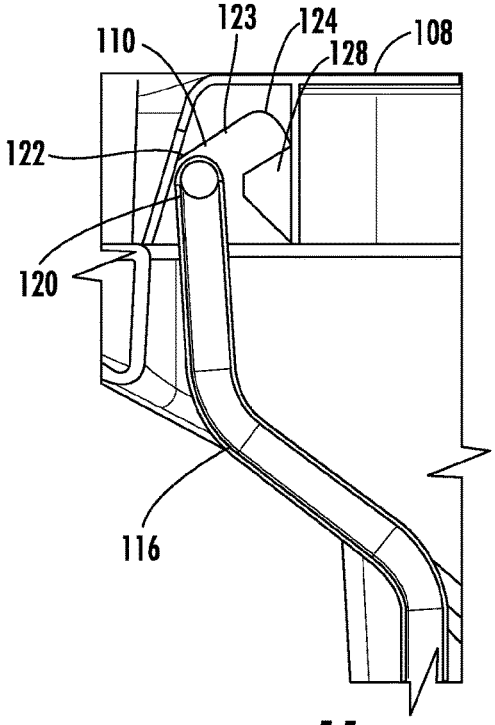
FIG. 11 is a cross-sectional partial perspective view of the lid and lift rod of an embodiment of a waste receptacle with pedal-operated lid, when the pedal is in the first position (i.e., at rest), in accordance with the present disclosure.
Figure 12:
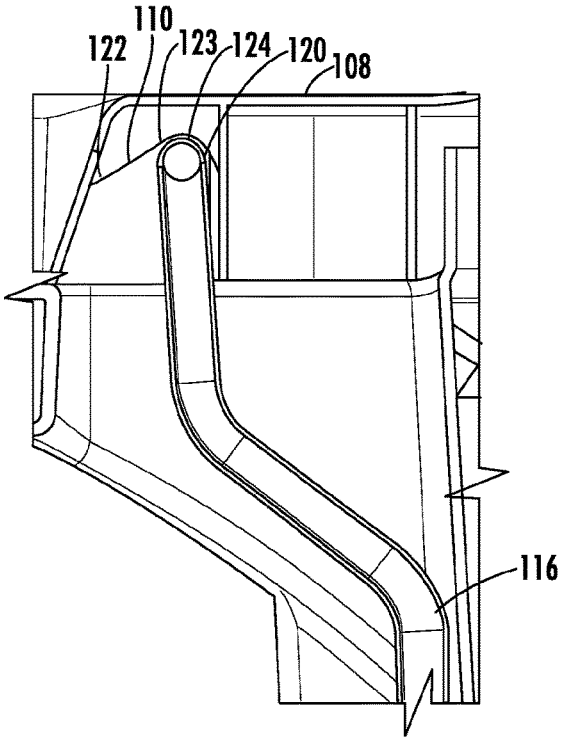
FIG. 12 is a cross-sectional partial perspective view of the lid and lift rod of the waste receptacle of FIG. 11, when the pedal is moving from the first position into the second position.

In some example embodiments, the lid 108 includes a cam feature for receiving the second end 120 of the lift rod 116. In one embodiment, as shown in FIGS. 2, 3 5, 6, and 11-13, the cam feature for the lid 108 includes a lid adjustment channel 110 having a first end 122 and a second end 124 and a top surface 123 extending from the first end 122 to the second end 124. As shown in FIGS. 10 and 11, when the pedal 112 is in the first position (i.e., at rest) and the lid 108 is in the closed position, the second end 120 of the lift rod 116 is disposed in the first end 122 near the entry of the channel 110. As shown in FIGS. 11-13, when a downward force is applied to the first end 112*a* of the pedal 112 and begins moving the pedal 112 from the first position to the second position (i.e., maximum actuation), the second end 120 of the lift rod 116 contacts and applies a force along the top surface 123 of the channel, thereby lifting the lid 108 as the lift rod 116 moves through the channel 110 from the first end 122 and ultimately is disposed in the second end 124 of the channel 110.

As used herein, the term "closed position," when used with referenced to the lid 108, refers to the lid 108 abutting the open top portion 105 of the enclosure 102. In some example embodiments, when in the closed position, the lid 108 lies in a plane perpendicular to the longitudinal axis of waste receptacle 100.

As shown in FIGS. 11-13, the lid 108 is rotatable from the closed position to the predetermined maximum pedal-adjusted angle, via the pedal 112 being pivoted from the first position to the second position. Thus, the lid 108 is disposed at the predetermined maximum pedal-adjusted angle when the pedal 112 is in the second position. In some example embodiments, the predetermined maximum pedal-adjusted angle is 90 degrees or less, measured relative the closed position. In some example embodiments, the predetermined maximum pedal-adjusted angle is from about 60 degrees to about 90 degrees, measured relative the closed position. In some example embodiments, as shown in FIG. 13, the predetermined maximum pedal-adjusted angle is about 80 degrees, measured relative the closed position. As used herein, the term "about" means plus or minus 10 percent of the numerical value of the number with which it is being used.

Figure 9:
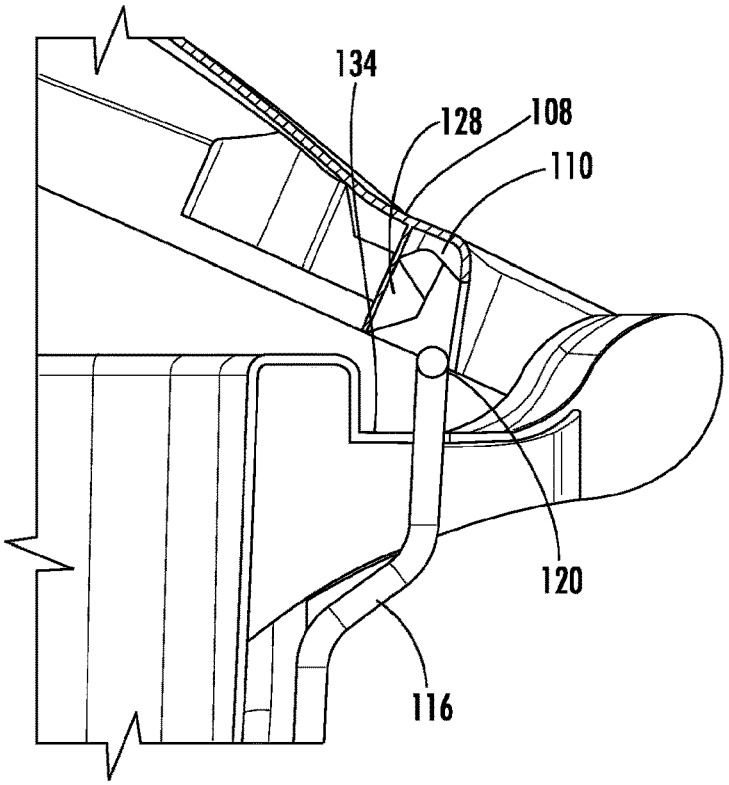
FIG. 9 is a cross-sectional partial plan view of the lid and lift rod of an embodiment of a waste receptacle with pedal-operated lid, when the pedal is in the first position (i.e., at rest), in accordance with the present disclosure.

As shown in FIG. 9, when the pedal 112 is in the first position (i.e., at rest) and because the second end 120 of the lift rod 116 is not fixedly attached to the lid 108 or permanently contained within the channel 110, the lid 108 is manually rotatable from the closed position to a fully open position. In one embodiment, the fully open position is a maximum open angle of about 270 degrees, relative the closed position.

In some example embodiments, the cam feature in the lid 108 for receiving the second end 120 of the lift rod 116 further includes one or more stop members 128 that contact the second end 120 of the lift rod 116 and prevent the lid 108 from rotating past the predetermined maximum pedal-adjusted angle when the pedal 112 is in the second position. For example, as shown in FIGS. 5-8, and 11-13, the channel 110 may include a plurality of stop members 128 that prevent the lid 108 from rotating past the predetermined maximum pedal-adjusted angle when the pedal is in the second position and the second end 120 of the lift rod 116 is disposed in the second end 124 of the channel 110. Thus, in some example embodiments, the second end 120 of the lift rod 116 is not permanently coupled to the lid 108. In certain example embodiments, as shown in FIGS. 9 and 10, when the pedal 112 is in the first position, the second end 120 of the lift rod 116 does not enter the second end 124 of the channel 110, such that the lid 108 is manually pivotable to the maximum open angle and rotation of the lid 108 is not restricted by the stop member 128.

Thus, in certain example embodiments, when the lift rod 116 is at rest, the user is free to open the lid 108, without using the foot pedal 112, to any angle, for example from 0 degrees to 270 degrees (see FIG. 9). If the user wishes to open the lid 108 using the foot pedal 112, the initial application of a downward force on the first end 112*a* of the foot pedal 112 moves the second end 120 of the lift rod 116 along the top surface 123 of the channel 110 to the second end 124 of the channel 110 (see FIGS. 11 and 12), thereby causing the lid 108 to rise from the closed position to the maximum pedal-adjusted angle. Upon the second end 120 of the lift rod 116 reaching the second end 124 of the channel, each individual end of the t-shaped second end 120 of the lift rod 116 contacts a corresponding stop surface of a corresponding stop member 128 on the lid 108. In one example embodiment, application of downward force on the first end 112*a* of the foot pedal 112 to move the pedal 112 to the second position opens the lid 108 to the maximum desired pedal-actuated opening angle, for example 80 degrees (see FIG. 13). Once the lid 108 reaches the maximum pedal-actuated opening angle, the stop members 128 contacting the second end 120 of the lift rod 116 prevent the lid 108 from opening further (see FIG. 13).

Figure 3:
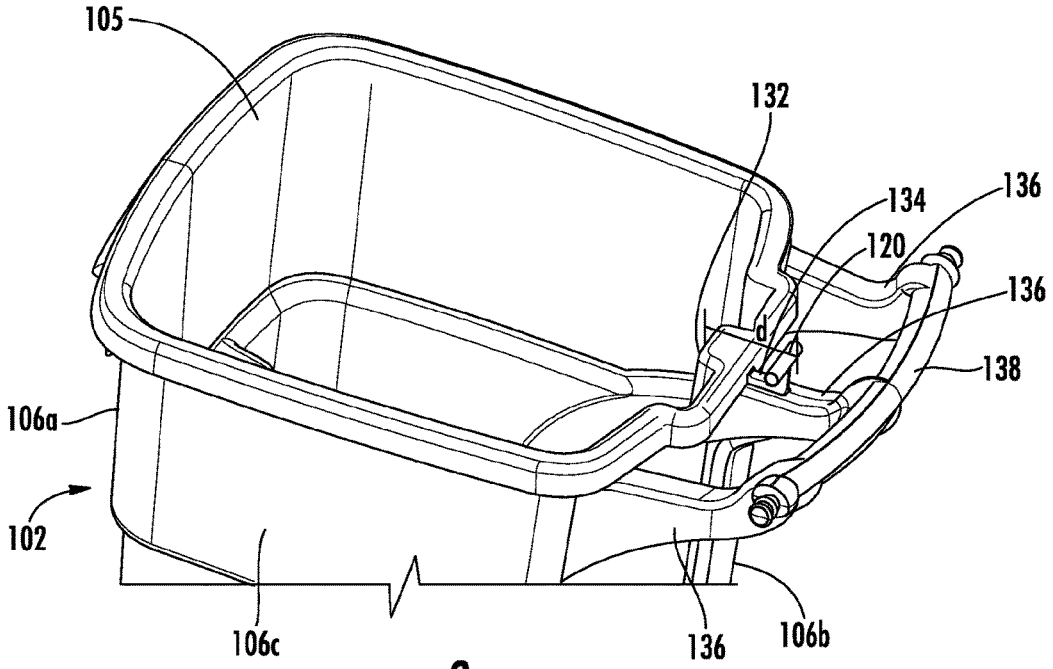
FIG. 3 is a partial upper perspective view of an embodiment of a waste receptacle with pedal-operated lid, with the lid removed, in accordance with the present disclosure.
Figure 4:
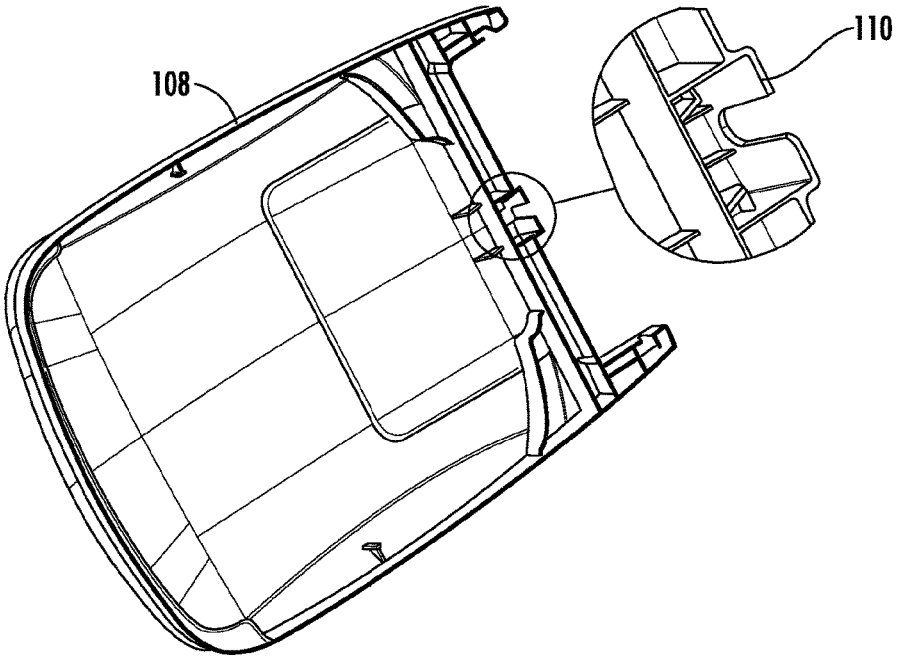
FIG. 4 is a lower perspective view of a lid of an embodiment of a waste receptacle with pedal-operated lid, in accordance with the present disclosure.
Figure 5:
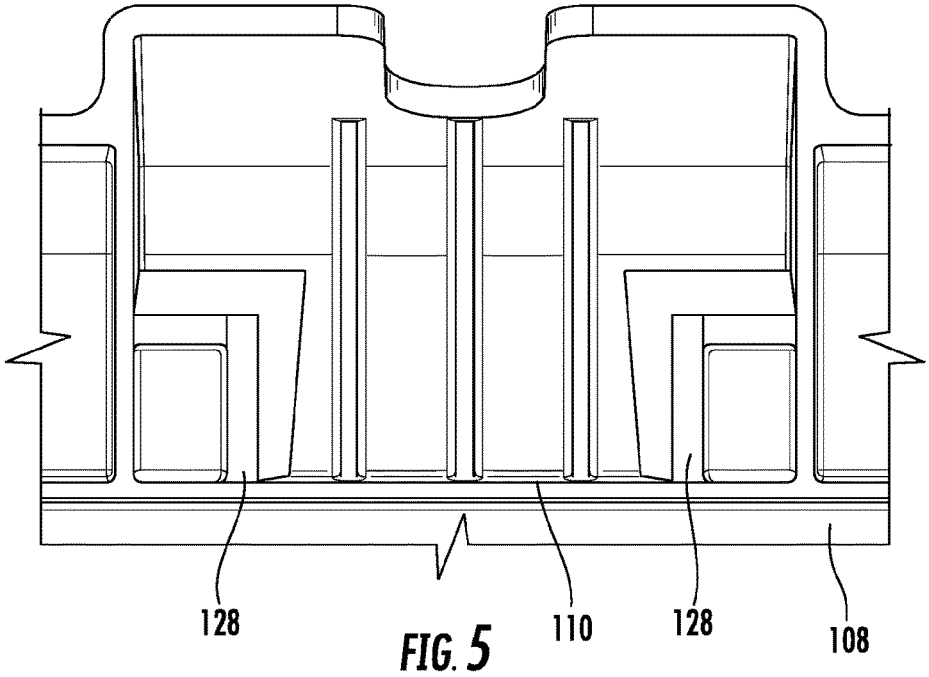
FIG. 5 is a partial bottom view of the channel of a lid of an embodiment of a waste receptacle with pedal-operated lid, in accordance with the present disclosure.
Figure 6:
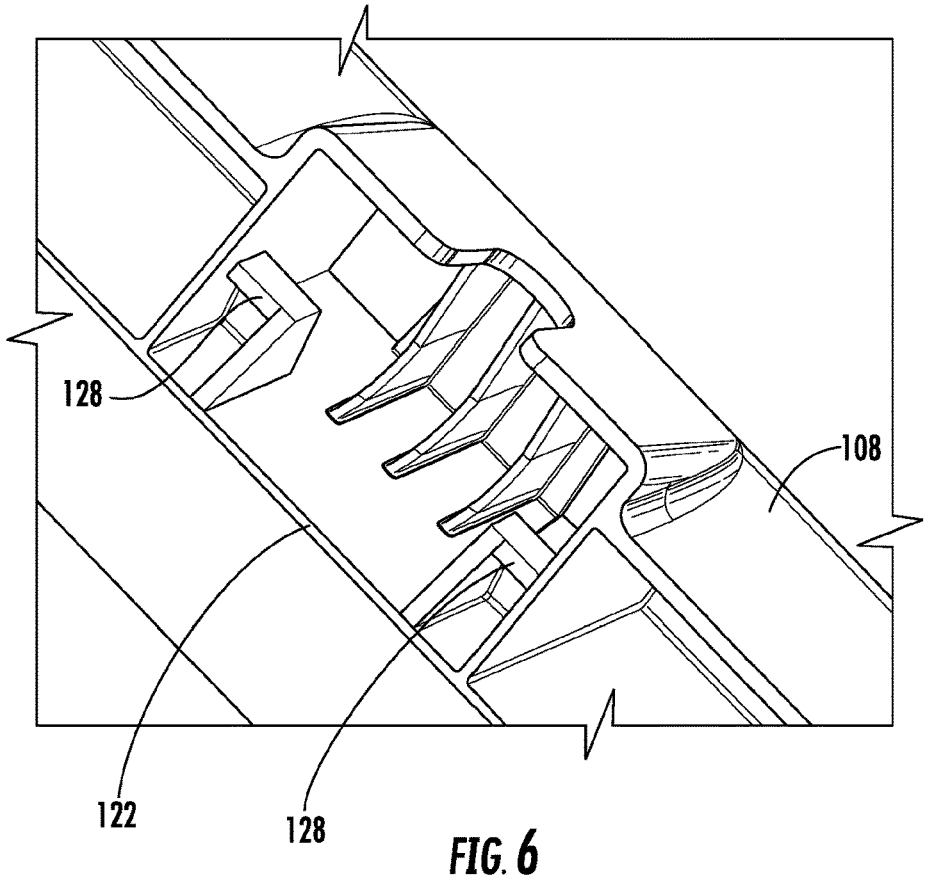
FIG. 6 is a partial lower perspective view of the channel of FIG. 5.

In certain example embodiments, as shown in FIG. 1, the second end 120 of the lift rod 116 is T-shaped. As used herein, the term "T-shaped" refers to the second end 120 of the lift rod 116 including a second rod member that is disposed perpendicularly or substantially perpendicularly to the longitudinal axis of the lift rod 116. It will be appreciated that other suitable shapes and designs of the second end 120 of the lift rod 116 may also be used. In one example embodiment, as shown in FIGS. 2 and 3, the lift rod 116 includes an angled portion 130 near the second end 120 of the lift rod 116, such that the second end 120 of the lift rod 116 is positioned a distance "d" from an edge 132 of the open top portion of the enclosure 102 when the pedal 112 is in the first position. In some embodiments, the distance "d" is from about 0.125 inches to about 0.5 inches. In one example embodiment, the distance "d" is about 0.25 inches. In certain example embodiments, the lift rod 116 is a hollow stainless steel tube having a diameter of about 0.5 inches, although solid rods, as well as other suitable lift rod materials, designs, and sizes may be used.

In certain example embodiments, as shown in FIG. 3, the waste receptacle 100 also includes a laterally disposed slot 134 in the enclosure 102 for receiving at least a portion of the elongated lift rod 116 therethrough. The slot 134 may restrict lateral movement of the lift rod 116. In some example embodiments, the enclosure 102 also includes at least one handle support 136 having a first end and opposing second end. The first end of each handle support 136 can be coupled to and extend from the rear sidewall 106*b* near the open top portion 105. The second end of each handle support 136 can be coupled to a receptacle handle 138. In one example embodiment, the elongated slot 134 is disposed in one of the handle supports 136. In one example embodiment, the enclosure 102 includes three handle supports 136 coupled to and extending from the rear sidewall 106*b* near the open top portion 105.

Figure 14:
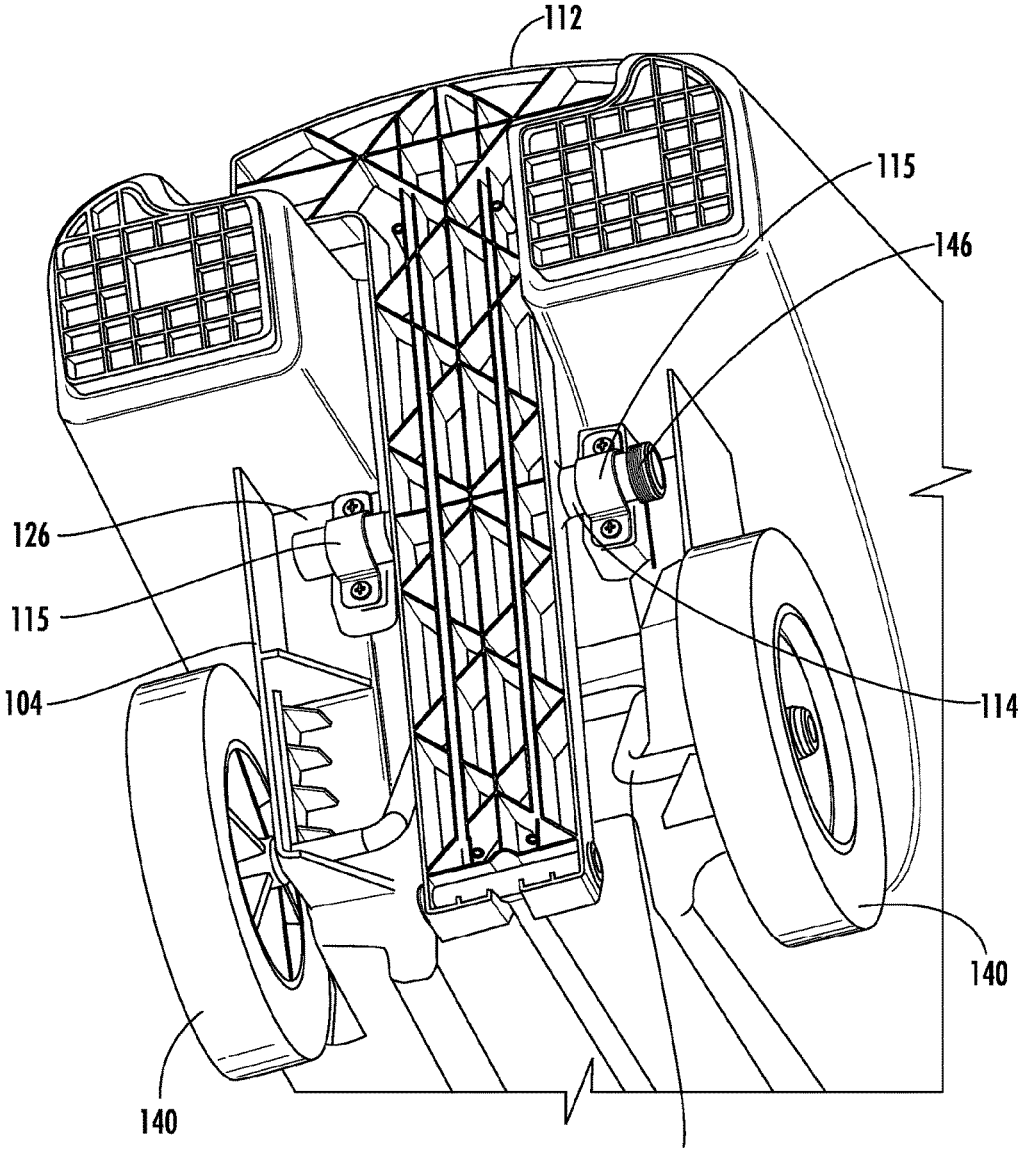
FIG. 14 is a partial lower perspective view of an embodiment of a waste receptacle with pedal-operated lid, in accordance with the present disclosure.

In certain example embodiments, as shown in FIGS. 1 and 2, the waste receptacle 100 also includes two or more wheels 140 coupled to the enclosed base portion 104. For example, as shown in FIG. 14, the wheels 140 may be coupled to an axle 142 that is coupled to the enclosed base portion 104. In one example embodiment, as shown in FIG. 14, the wheels 140 are coupled to the enclosed base portion 104 via an axle 142 having a U-shaped section to prevent interference of the axle 142 with the pedal 112.

In some example embodiments, the wheel axle 142 is adjustable from a first position to a second position such that, when the axle 142 is in the first position, the wheels 140 are in a first position relative to the enclosed base portion 104 and, when the axle 142 is in the second position, the wheels 140 are disposed in a second position relative the enclosed base portion 104 to accommodate nesting of the base portion. For example, the axle 142 may be slideably coupled to the enclosed base portion 104 such that the wheels 140 may be disposed in a nesting position to accommodate nesting of the base portion into a similar waste receptacle and the wheels 140 may be disposed in a locked position for shipping and rolled use.

Figure 15:
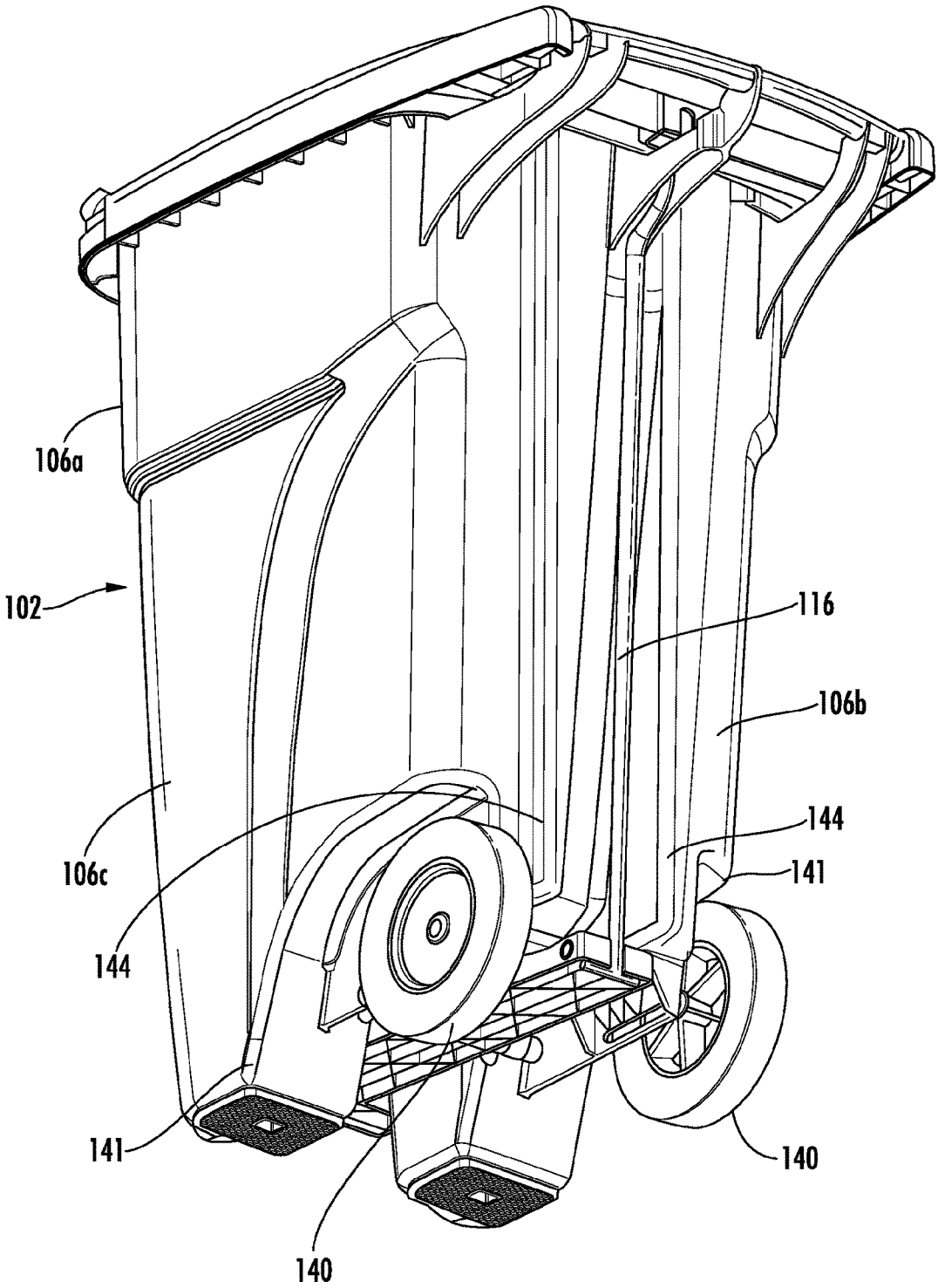
FIG. 15 is a rear lower perspective view of the waste receptacle of an embodiment of a waste receptacle with pedal-operated lid, in accordance with the present disclosure.

In some example embodiments, as shown in FIG. 15, the enclosure 102 includes four sidewalls 106, including a front wall 106*a*, a rear wall 106*b*, and two opposing sidewalls 106*c* and 106*d*, and the wheels 140 are disposed inboard relative the opposing sidewalls 106*c* and 106*d*. For example, each wheel 140 may be disposed in a wheel cavity 141 defined by the enclosure 102 such that the external surfaces of the wheels 140 do not extend past the external surfaces of the other portions of the receptacle 100 (e.g., the sidewalls 106, base portion, handle 138).

Figure 19:
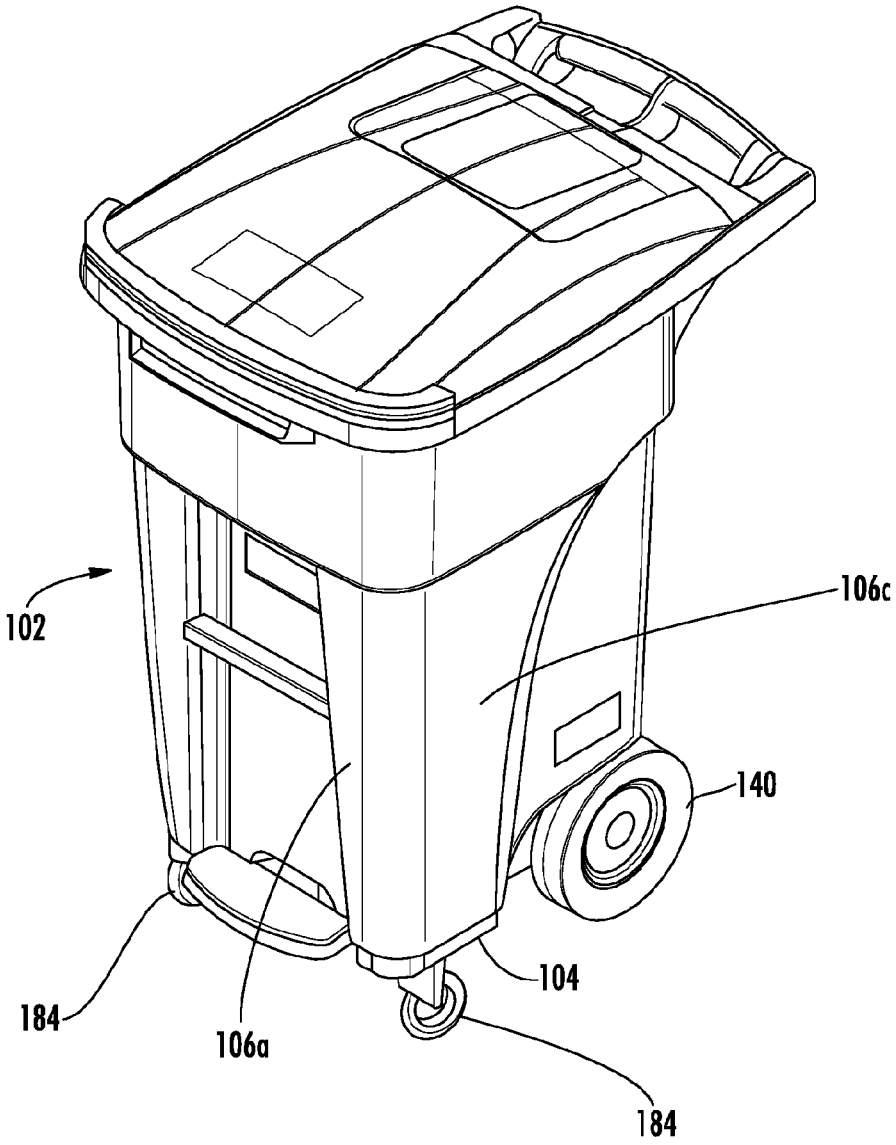
FIG. 19 is an upper perspective view of an embodiment of a waste receptacle with pedal-operated lid, in accordance with the present disclosure.

In some example embodiments, as shown in FIG. 19, the waste receptacle includes, in addition to the wheels 140, one or more smaller wheels 184, such as swivel casters, disposed on the base portion 104 at or near the front wall 106*a* of the enclosure 102. For example, the waste receptacle may include one or two casters 184 positioned at or near the front wall 106*a* of the enclosure 102 on the base portion 104. For example, one caster may be positioned on the base of the receptacle at the center of the front wall 106*a* (not illustrated) or two casters 184 may be positioned near the edges formed by the front wall 106*a* and sidewalls 106*c* and 106*d*, as shown in FIG. 19. For example, the casters 184 may allow the waste receptacle to be wheeled without requiring the user to tilt the receptacle toward the wheels 140 such that the base portion 104 is elevated off of the floor.

In certain example embodiments, the waste receptacle 100 is designed for automated or semi-automated collection services. For example, the waste receptacle 100 may include auto-lift and other automated collection features known in the art. In some example embodiments, the waste receptacle conforms to ANSI Z245.60 auto-dumping standards.

In certain example embodiments, the enclosure 102 has a volume of from about 30 gallons to about 100 gallons. For example, the enclosure may have a volume of about 32 gallons, about 50 gallons, about 65 gallons, or about 95 gallons. Thus, the presently disclosed pedal-operated lift rod feature may be used with large format waste receptacles, such as large "rollout" receptacles for automated collection. However, any size receptacle may be used.

Figure 16:
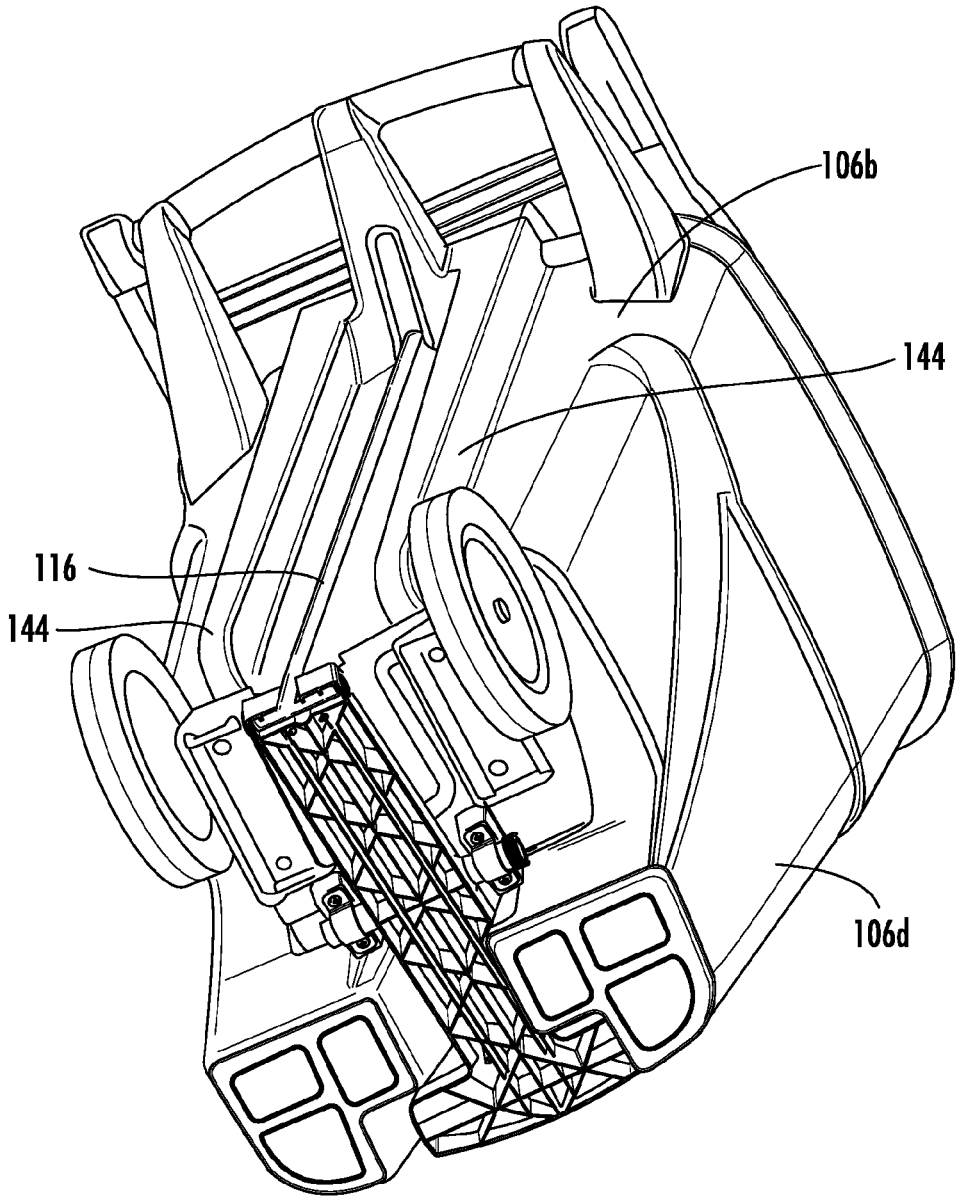
FIG. 16 is a lower perspective view of an embodiment of a waste receptacle with pedal-operated lid, in accordance with the present disclosure.

In certain example embodiments, as shown in FIGS. 15 and 16, the rear sidewall 106*b* of the enclosure 102 includes multiple vent channels 144 extending substantially parallel (e.g., vertically) along an outer surface of the rear sidewall 106*b*. For example, U.S. Pat. No. 7,712,623 which is incorporated by reference herein, discloses vent channels that may be provided in the present receptacle 100. For example, the vent channels 144 may provide vents (e.g., an air passageway) at the open top portion of the enclosure 102, such that the formation of a partial vacuum in the interior of the enclosure 102 upon attempted removal of a liner from the interior of the enclosure 102 is prevented. In some example embodiments, the lift rod 116 extends in a direction substantially parallel to the outer surface of the rear sidewall 106*b* (e.g., substantially vertically) and is disposed between at least two of the vent channels 144. The vent channels 144 may serve the additional function of protecting the lift rod from damage because each vent channel 144 extends a distance away from the outer surface of the rear sidewall 106*b* that is greater that the distance that the lift rod is positioned away from the rear sidewall 106*b*.

In certain example embodiments, as shown in FIG. 14, the waste receptacle 100 includes a pedal retention spring 146 configured to maintain the pedal 112 in the first position in the absence of actuation by a user. For example, the pedal retention spring 146 may be configured to maintain the pedal in the at-rest position until a predetermined force is applied to the first end 112*a* of the pedal 112. For example, the pedal retention spring 146 may prevent the pedal 112 from pivoting into the second position when the receptacle 100 is inverted, such as during automated collection. In some example embodiments, the pedal retention spring 146 is coupled along one end to the pedal axle 114 and along the opposing end to the outer surface of the enclosed base portion 102. In one example embodiment, the pedal retention spring 146 is a torsion spring.

The above-described waste receptacles include a fully openable lid in addition to a pedal-operated lid opening mechanism. These receptacles allow the operator to use a foot pedal to open the lid to a pre-determined maximum opening angle while at the same time preventing the lid from going beyond the predetermined maximum opening angle. In addition, the operator can desirably open the lid without the use of the foot operated lift mechanism beyond the maximum opening angle obtainable by utilizing the foot pedal. Thus, the present disclosure provides the benefit of a hands-free step-on lid opening feature combined with a fully openable lid design.

In certain example embodiments, the waste receptacles are suitable for street-side use and automated collection. In contrast to known receptacles for automated collection, the present receptacles provide a pedal-operated opening mechanism, to improve the ease of use of these receptacles. For example, a user may operate the pedal to access the open top portion of the enclosure and deposit waste material (e.g., bags of waste material) therethrough. Additionally, the receptacles meet the requirement of a fully-openable lid for automated collection.

While the disclosure has been described with reference to a number of embodiments, it will be understood by those skilled in the art that the disclosure is not limited to such disclosed embodiments. Rather, the disclosed embodiments can be modified to incorporate any number of variations, alterations, substitutions, or equivalent arrangements not described herein, but which are commensurate with the spirit and scope of the disclosure.

We claim:

1. A waste receptacle, comprising:

an enclosure comprising an enclosed base portion and at least one sidewall extending from the enclosed base portion, the at least one sidewall defining an open top portion to receive waste material therethrough;

a lid hingedly coupled to the enclosure, the lid defining a channel having a first end and a second end;

a pedal pivotably coupled to the enclosed base portion and pivotable from a first position to a second position; and an elongated lift rod comprising a first end coupled to the pedal and a T-shaped second end that is distal the first end, the T-shaped second end of the elongated lift rod being disposed in the first end of the channel when the pedal is in the first position and the lid is disposed in a closed position abutting the open top portion of the enclosed base portion and being disposed in the second end of the channel when the pedal is in the second position, wherein the lid is disposed at a predetermined maximum pedal-adjusted angle of from about 60 degrees to about 90 degrees, measured relative the closed position, when the pedal is in the second position, wherein the channel comprises a stop member that prevents the lid from rotating past the predetermined maximum pedal-adjusted angle when the pedal is in the second position, and wherein, when the pedal is in the first position, the lid is manually rotatable from the closed position to a maximum open angle of about 270 degrees, relative the closed position.

2. The waste receptacle of claim 1, wherein the predetermined maximum pedal-adjusted angle is about 80 degrees, measured relative the closed position.

3. The waste receptacle of claim 1, further comprising a plurality of wheels coupled to the enclosed base portion.

4. The waste receptacle of claim 3, wherein:

the at least one sidewall comprises a front wall, a rear wall, and two opposing sidewalls, and the plurality of wheels are disposed inboard relative the opposing sidewalls.

5. The waste receptacle of claim 4, further comprising:

an axle coupled to the enclosed base portion and that is adjustable from a first position to a second position, wherein the plurality of wheels are coupled to the axle such that, when the axle is in the first position, the plurality of wheels are in a first position relative to the enclosed base portion and, when the axle is in the second position, the plurality of wheels are disposed in a second position relative the enclosed base portion to accommodate nesting of the enclosed base portion.

6. The waste receptacle of claim 4, wherein the plurality of wheels are coupled to the enclosed base portion via a U-shaped axle to prevent interference of the axle with the pedal.

7. The waste receptacle of claim 1, wherein the enclosed base portion defines a channel to accommodate at least a portion of the pedal.

8. The waste receptacle of claim 1, wherein the waste receptacle conforms to ANSI Z245.60 auto-dumping standards.

9. The waste receptacle of claim 1, wherein the pedal is pivotable from the first position to the second position upon application of at least 18 pounds of force thereto by a user.

10. The waste receptacle of claim 1, wherein the enclosure has a volume of from about 30 gallons to about 100 gallons.

11. The waste receptacle of claim 1, wherein the enclosure has a volume of about 32 gallons, about 50 gallons, about 65 gallons, or about 95 gallons.

12. The waste receptacle of claim 1, wherein the T-shaped second end of the elongated lift rod is not permanently coupled to the lid.

13. The waste receptacle of claim 1, further comprising a laterally disposed slot in the enclosure for receiving at least a portion of the elongated lift rod therethrough, wherein the slot restricts lateral movement of the elongated lift rod.

14. The waste receptacle of claim 13, wherein:

the enclosure further comprises at least one handle support coupled to and extending from one of the at least one sidewall near the open top portion, and the slot is disposed in one of the at least one handle support.

15. The waste receptacle of claim 14, wherein the enclosure comprises three handle supports coupled to and extending from one of the at least one sidewall near the open top portion.

16. The waste receptacle of claim 1, wherein the elongated lift rod further comprises an angled portion near the T-shaped second end of the elongated lift rod, such that the T-shaped second end of the elongated lift rod is positioned from about 0.125 inch to about 0.5 inch from an edge of the open top portion when the pedal is in the first position.

17. The waste receptacle of claim 1, wherein the elongated lift rod comprises a stainless steel tube having a diameter of about 0.5 inch.

18. The waste receptacle of claim 1, wherein:

one of the at least one sidewall comprises a plurality of vent channels extending substantially vertically along an outer surface of the one of the at least one sidewall, and the elongated lift rod extends substantially vertically along the outer surface of the one of the at least one sidewall and is disposed between at least two of the plurality of vent channels.

19. The waste receptacle of claim 1, further comprising a pedal retention spring configured to maintain the pedal in the first position.

20. The waste receptacle of claim 19, further comprising:

a pedal axle coupled to the enclosed base portion, the pedal being coupled to the pedal axle, wherein the pedal retention spring is coupled to the pedal axle.

21. The waste receptacle of claim 19, wherein the pedal retention spring is a torsion spring.

* * * * *